US007079793B2

(12) United States Patent
Amano et al.

(10) Patent No.: US 7,079,793 B2
(45) Date of Patent: Jul. 18, 2006

(54) IMAGE FORMING APPARATUS AND IMAGE FORMING METHOD

(75) Inventors: Takafumi Amano, Kawasaki (JP); Susumu Nomura, Yokohama (JP); Tetsuo Kato, Yokohama (JP); Takashi Ikeda, Tagata-gun (JP); Yukie Kobayashi, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/991,507

(22) Filed: Nov. 19, 2004

(65) Prior Publication Data

US 2005/0111883 A1 May 26, 2005

(30) Foreign Application Priority Data

Nov. 21, 2003 (JP) ..... 2003-393060
Jul. 16, 2004 (JP) ..... 2004-210540

(51) Int. Cl.
*G03G 15/08* (2006.01)

(52) U.S. Cl. ..... 399/254; 399/119; 399/256; 399/263

(58) Field of Classification Search ..... 399/24, 399/25, 27, 119, 120, 149, 252–256, 258, 399/259, 263
See application file for complete search history.

(56) References Cited

U.S. PATENT DOCUMENTS 6,330,414 B1 * 12/2001 Takuma et al. ..... 399/267
6,525,753 B1 * 2/2003 Matsuda ..... 347/131
6,577,824 B1 6/2003 Itoh et al.
7,003,234 B1 * 2/2006 Itoh ..... 399/27

FOREIGN PATENT DOCUMENTS

EP 0 689 105 A2 12/1995
EP 1 091 265 A2 4/2001
JP 2001-249545 A 9/2001

OTHER PUBLICATIONS

U.S. Appl. No. 10/866,693, filed Jun. 15, 2004, Amano et al.
U.S. Appl. No. 10/802,046, filed Mar. 17, 2004, Ikeda et al.
U.S. Appl. No. 10/802,047, filed Mar. 17, 2004, Ikeda et al.
U.S. Appl. No. 10/802,051, filed Mar. 17, 2004, Katoh et al.

* cited by examiner

*Primary Examiner*—Hoang Ngo
(74) *Attorney, Agent, or Firm*—Foley & Lardner LLP

(57) ABSTRACT

A developing unit has first and second partition walls and which divide the inside of a developer reservoir into first to third chambers parallel to the developing roller, and first to third mixers which are disposed in the first to third chambers. The first mixer supplies developer to the developing roller by stirring and carrying from one end side to the other end side. The second mixer feeds by stirring and carrying the toner replenished from a replenish device and developer fed from the first chamber to one end side of the first mixer. The third mixer feeds the toner collected from a collection mechanism to one end side of the first mixer by stirring and carrying at a speed lower than the second mixer.

52 Claims, 12 Drawing Sheets

IMAGE FORMING APPARATUS AND IMAGE FORMING METHOD

CROSS-REFERENCE TO RELATED APPLICATIONS

This application is based upon and claims the benefit of priority from prior Japanese Patent Applications No. 2003-393060, filed Nov. 21, 2003; and No. 2004-210540, filed Jul. 16, 2004, the entire contents of both of which are incorporated herein by reference.

BACKGROUND OF THE INVENTION

1. Field of the Invention

The present invention relates to an image forming apparatus which is applied as an electrophotographic copying machine, and an image forming method.

2. Description of the Related Art

In this kind of image forming apparatus, an electrostatic latent image is formed on a photoconductor drum as an image holding element, and the latent image is developed as a toner image by a developing unit. The toner image is transferred to a paper sheet in a transfer unit. The toner remained on the photoconductor drum at the time of transfer is eliminated by a cleaning unit.

In a certain image forming apparatus, a toner replenish device replenishes a developing unit with fresh toner, and a toner collection mechanism collects the toner eliminated by a cleaning unit and supplies the collected toner to a developing unit for reusing.

A developing unit contains a developing roller in a developer reservoir, and has first and second mixers as first and second stirring and carrying members.

The first mixer rotates to stir and carry a developer in a first direction from one end side to the other end side, and supplies the developer to a developing roller. The second mixer rotates to carry the developer in a second direction reverse to the first direction, and circulates the developer to the first mixer.

Fresh toner replenished by the toner replenish device and recycled toner collected by the toner collection mechanism are fed to one end side of the second mixer, and stirred and carried as described in U.S. Pat. No. 6,577,824.

However, in the prior art, as replenished toner and recycled toner are fed to one end side of the second mixer, in which they are mixed, stirred and carried, the replenished fresh toner is sufficiently charged, but the recycled toner is not sufficiently changed.

The replenished toner is fresh, and can be sufficiently charged at the stirring and carrying speed given by the rotation of the second mixer. But, the recycled toner is often degraded, and cannot be sufficiently charged at the stirring and carrying speed of the second motor. Thus, good development is not expected.

BRIEF SUMMARY OF THE INVENTION

The present invention has been made in order to solve the above problems. Accordingly, it is an object of an aspect of the present invention is to provide an image forming apparatus and an image forming method, which can develop an image satisfactorily by chagrining sufficiently even with recycled toner.

According to an aspect of the present invention, there is provided an image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising first and second partition members which divide the inside of the developer reservoir into first to third chambers substantially parallel to the developing roller; a first connecting opening which is formed in the first partition member, connects the first and second chambers; a second connecting opening which is formed in the second partition member, and connects the second and third chambers; a first stirring and carrying member which is provided in the first chamber, and supplies developer to the developing roller by stirring and carrying in a first direction from one end side to the other end side of the chamber; a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a third stirring and carrying member which is provided in the third chamber, and feeds the toner collected by the collection device to one end side of the first stirring and carrying member by stirring and carrying in the second direction at a speed lower than the second stirring and carrying member.

According to another aspect of the invention, there is provided an image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising dividing the inside of the developer reservoir into first to third chambers substantially parallel to the developing roller by the first and second partition members; forming a first connecting opening in the first partition member, and connecting the first and second chambers; forming a second connecting opening in the second partition member, and connecting the second and third chambers; supplying the developer in the first chamber to the developing roller by a first stirring and carrying member by stirring and carrying in a first direction from one end side to the other end side of the chamber; feeding the developer replenished from the replenish device and toner fed from the first chamber to the second chamber through the first connecting opening to one end side of the first stirring and carrying member by a second stirring and carrying member by stirring and carrying in a second direction reverse to the first direction; and feeding the toner collected by the collection device to one end side of the first stirring and carrying member by a third stirring and carrying member by stirring and carrying in the second direction at a speed lower than the second stirring and carrying member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The present invention will be explained in detail hereinafter with reference to the embodiments shown in the accompanied drawings.

Figure 1:
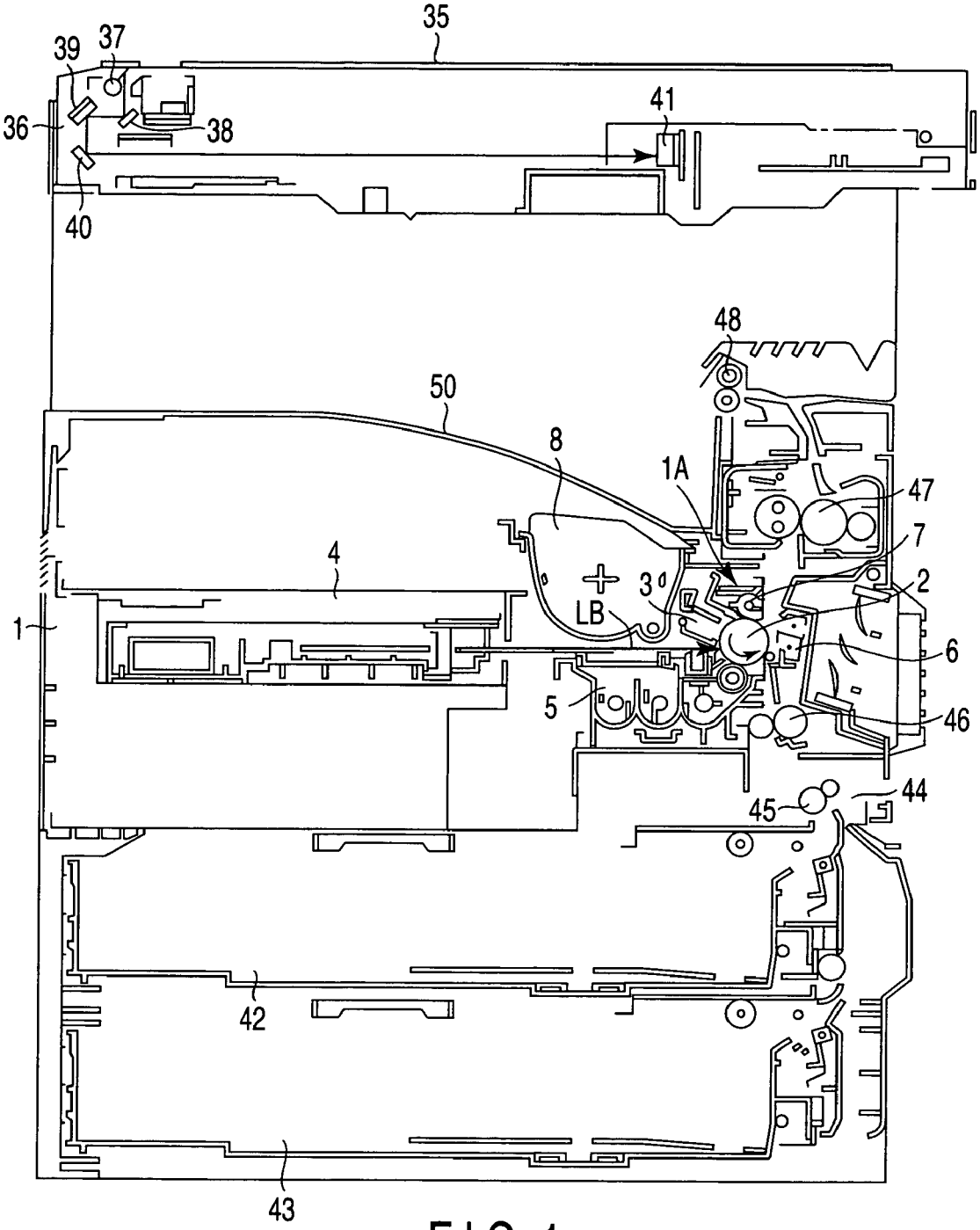
FIG. 1 shows an internal structure of an electrophotographic copying machine according to an embodiment of the present invention.

FIG. 1 shows schematically the internal structure of an electrophotographic copying machine as an image forming apparatus according to an embodiment of the present invention.

In the drawing, a reference numeral 1 denotes a main unit of the copying machine. An image forming unit 1A is provided in one side of the middle of the main unit 1 of the copying machine. The image forming unit 1A has a photoconductor drum 2 as an image holding element rotatable in the arrow direction. A charger 3 to charge the surface of the photoconductive drum 2, a laser unit 4 to form a static latent image on the surface of the photoconductor drum 2, a developing unit 5 to develop the static latent image with toner on the photoconductor drum 2, a transfer charger 6 as a transfer device to transfer the toner image on the photoconductive drum 2 to a paper sheet, and a cleaning unit 7 to eliminate the toner remained on the photoconductive drum 2 are disposed around the photoconductive drum 2 in this order along the rotating direction of the drum 2.

Figure 2:
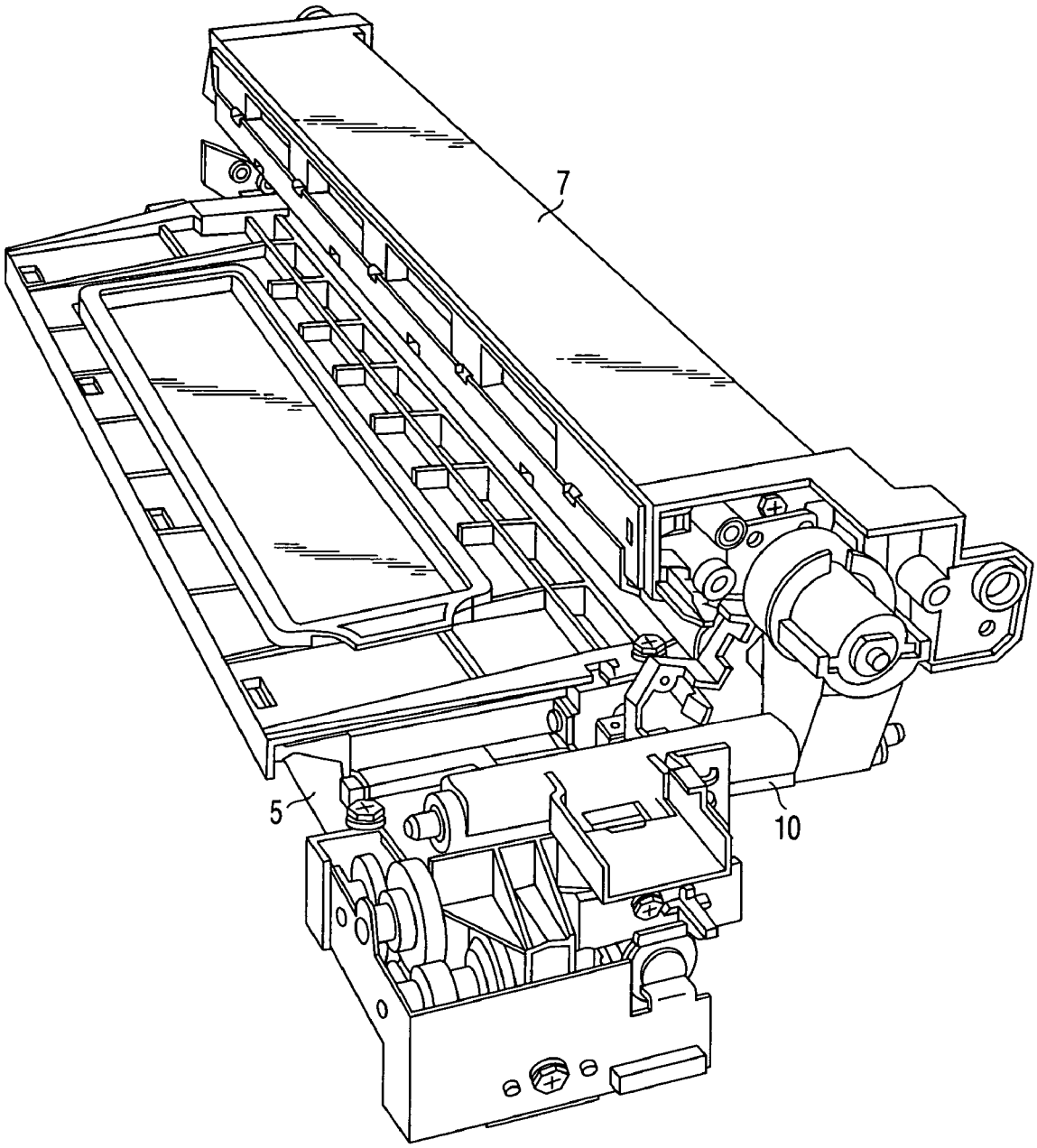
FIG. 2 is a perspective view showing a developing unit provided in the electrophotographic copying machine of FIG. 1.

A toner replenish device 8 is provided as a replenish device above the developing unit 5. The developing unit 5 contains 2-component developer composed of carrier and toner. The developing unit 5 is connected to the cleaning unit 7 through a collection mechanism 10 as a collection device as shown in FIG. 2.

In the collection mechanism 10 of this embodiment, auger is used to carry toner. As the cleaning unit 7, an existing cleaning blade or cleaning brush is used.

A document table 35 is provided at the top of the main unit 1 of the copying machine. A scanner 36 is provided under the document table 35 to expose the document placed on the document table 35. The scanner has a light source 37 to radiate light to a document, a first reflection mirror 38 to reflect the light from a document in a given direction, second and third reflection mirrors 39 and 40 to reflect the light sequentially from the reflection mirror 38, and a light receiving element 41 to receive the light from the third reflection mirror 40.

Several stages of paper feed cassettes 42 and 43 are provided in the lower part of the main unit 1 of the copying machine. The paper cassettes 42 and 43 feed paper sheets. The paper sheet is conveyed upward through the conveying system 44. In the conveying system 44, a pair of conveying rollers 45, a pair of registration rollers 46, an image transfer unit, a pair of fixing rollers 47, and a pair of exhaust rollers 48 are disposed.

When an image is formed, the light source 37 radiates light to the document placed on the document table 35. This light is reflected from the document and received by the light receiving element 41 through the first to third reflection mirrors 38–40, and the document image is read. Based on the read information, the laser unit 4 radiates a laser beam LB to the surface of the photoconductor drum 2. The surface of the photoconductor drum 2 is charged to be negative polarity by the charger 3. The photoconductor drum 2 is exposed by the laser beam LB radiated from the laser unit 4. The surface potential of the photoconductor drum 2 becomes close to 0 according to the image density in the area corresponding to the image portion of the document, and a static latent image is formed. The static latent image is opposed to the developing unit 5 by the rotation of the photoconductor drum 2, and becomes a visible image at this position by absorbing the toner supplied through the carrier.

In this time, a paper sheet is fed from the paper feed cassette 42 or 42, conveyed, adjusted by the registration roller 46, and sent to the image transfer unit disposed between the transfer charger 6 and photoconductor drum 2, where the visible image of the photoconductor drum 2 is transferred to the paper sheet.

The paper sheet with the image transferred is conveyed to the fixing rollers 47, where the paper sheet is pressed and heated to fix the image. After the fixing, the paper sheet is ejected to the paper ejection tray 50 through the paper ejecting rollers 48.

The toner not transferred to the paper sheet in the image transfer unit and remained on the surface of the photoconductor drum 2 is eliminated by the cleaning unit 7, and returned to the developing unit 5 by the collection mechanism 10 for reusing. When the toner in the developing unit 5 is consumed by the above phenomenon, toner is replenished from the toner replenish reservoir 8.

Figure 3:
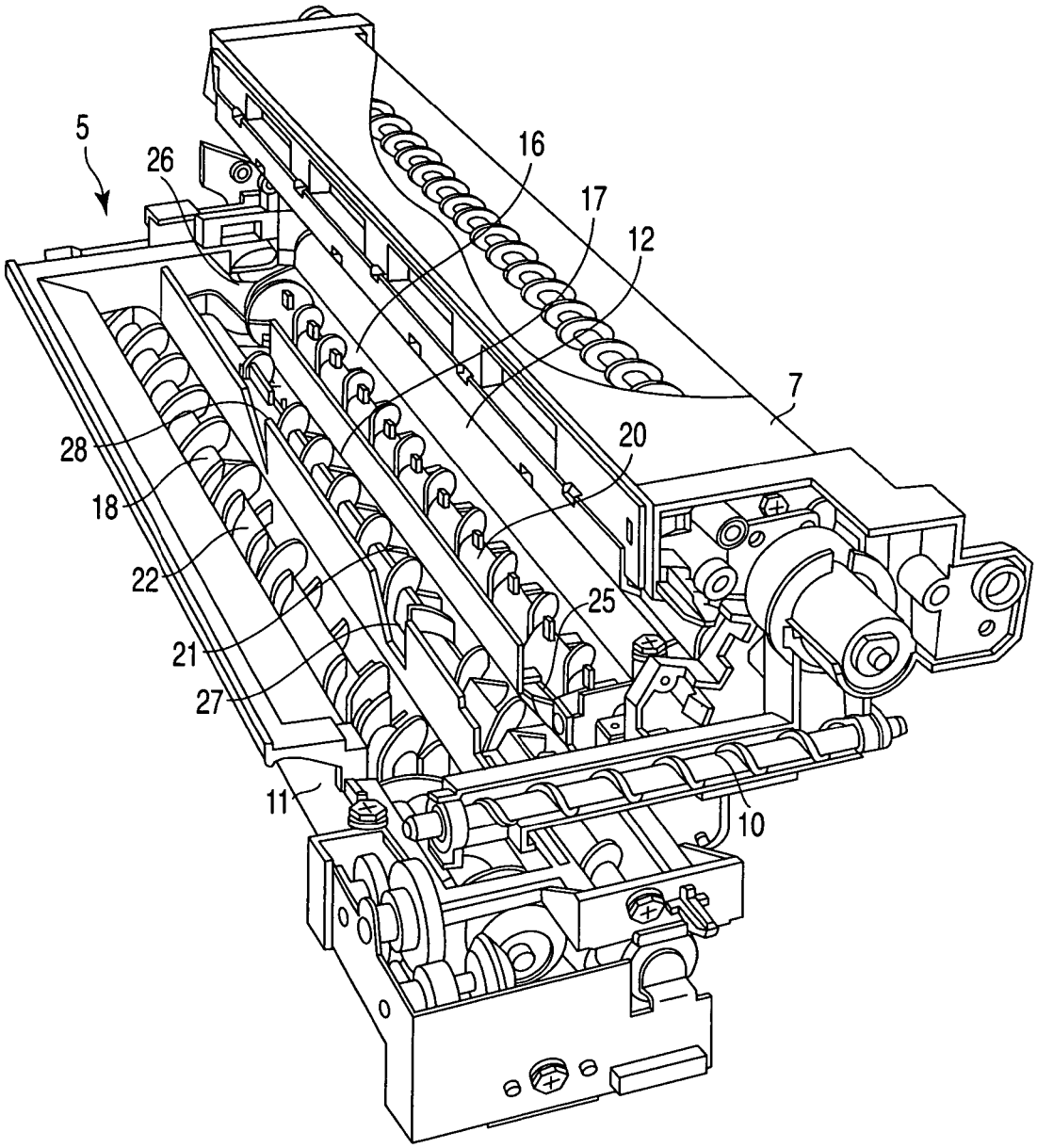
FIG. 3 is a perspective view showing the internal structure of the developing unit of FIG. 2.

Next, the developing unit 5 will be explained based on FIG. 3 and FIG. 4.

The developing unit 5 has a developer reservoir 11. A developing roller 12 is rotatably provided in the developer reservoir 11. The developing roller 12 is opposed to the lower part of the photoconductor drum 2, and rotates to supply developer to the photoconductor drum 2.

The inside of the developer reservoir 11 is divided into first to third chambers 16, 17 and 18 along and substantially parallel to the axial direction of the photoconductor drum 2 by partition walls 14 and 15 as first and second partition members. A first mixer 20 is provided in the first chamber 16 as a first stirring and carrying member. A second mixer 21 is provided in the second chamber 17 as a second stirring and carrying member. A third mixer is provided in the third chamber 18 as a third stirring and carrying member.

Figure 8:
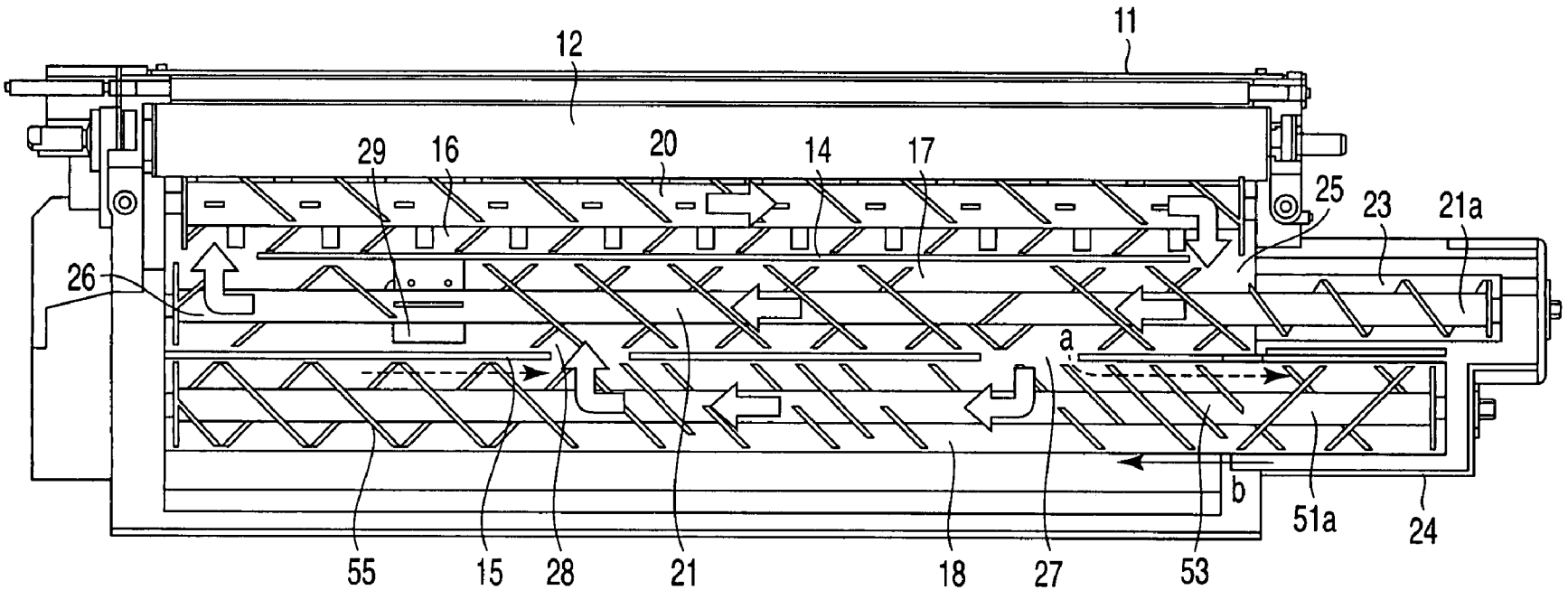
FIG. 8 is a plane view showing the flow of developer in the developing unit.

The first mixer 20 rotates to stir and carry developer in the first direction from one end side to the other end side (indicated by an arrow in FIG. 8), and supplies the developer to the developing roller 12. The second and third mixers 21 and 22 rotate to stir and carry developer in the second direction reverse to the first direction (indicated by an arrow in FIG. 8), and supply the developer to the one end side of the first mixer 20.

The second and third mixers 21 and 22 are rotated and driven by a driving mechanism 61 as a driving means. The driving mechanism 61 has a driving motor 62 as a single driving source, and a driving gear 63 rotated by the driving motor 62. The driving gear 63 is connected to a rotation shaft 51 described later of the third mixer 22 through a large-diameter power transmission gear 64. The power transmission gear 64 is connected to a rotation shaft 21*a* of the second mixer 21 through a small-diameter power transmission gear 65.

With this structure, the developer carrying speed of the third mixer 22 is reduced to approximately ⅙ of that of the second mixer 21, and the developer stirring and carrying time of the third mixer 22 becomes longer than that of the second mixer 21.

The second and third mixers 21 and 22 may be separately driven by driving motors with different speeds.

The collected toner carrying speed may be reduced lower than the developer carrying speed of the second mixer 21 by providing the third mixer 22 with a blade to feed the collected toner in the direction reverse to the second direction.

Figure 9:
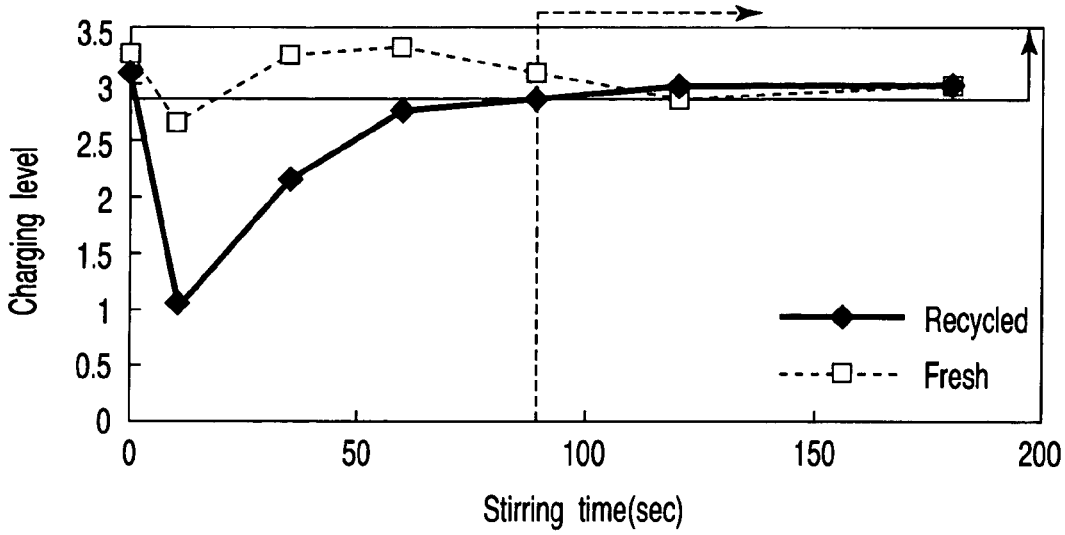
FIG. 9 is a graph showing the developer charging level at every stirring time when fresh toner and recycled toner are inputted 5 g each from a toner supply port in a conventional 2-circulation system developing unit.
Figure 10:
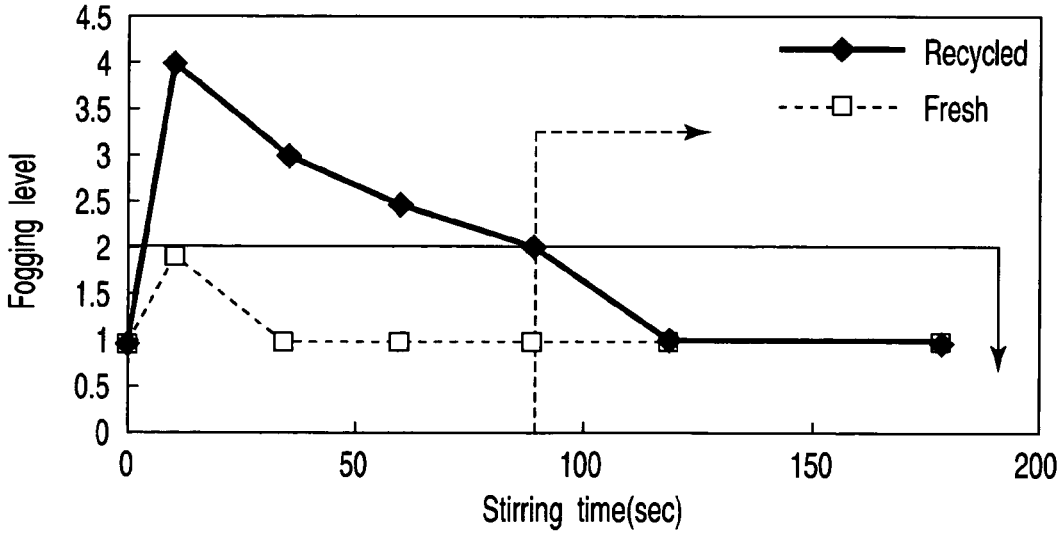
FIG. 10 is a graph showing the image fogging level at every stirring time when fresh toner and recycled toner are inputted 5 g each from a toner supply port in a conventional 2-circulation system developing unit.

FIG. 9 and FIG. 10 are graphs showing the developer charging level and image fogging level at every stirring time, respectively, when fresh toner and recycled toner are inputted 5 g each from a toner supply port in a developing unit which circulates and carries developer with two mixers.

In the developing mechanism and developer used for the test, as seen from the test results, the rising of the recycled toner is slow compared with the fresh toner charging level, and rises to the same charging level as the fresh toner about 60 seconds, desirably 90 seconds later.

As to the image fogging level obtained at the same time, the fogging level is little deteriorated in the fresh toner, but much deteriorated in the recycled toner. It is seen that as the stirring is continued, the fogging level becomes good and reaches the acceptable level 90 seconds later.

Therefore, in the developing unit and developer (toner) used in this embodiment, the time required to use for developing after fresh toner is supplied is set to 15 seconds. It is seen that this stirring time is no problem for the fresh toner, but 4 to 6 times longer, 60 to 90 seconds, must be waited for the recycled toner until the charging level becomes equal to the fresh toner, and image fogging occurs as a result.

According to the above results, it is seen in the case of this embodiment that the stirring time is 15 seconds for the second mixer 21, but 4 to 6 times longer, 60 seconds desirably 90 seconds, is necessary for the third mixer 22. Thus, the stirring and carrying speed of the third mixer 22 is set to about ¼ to ⅙ of the second mixer 21.

Figure 4:
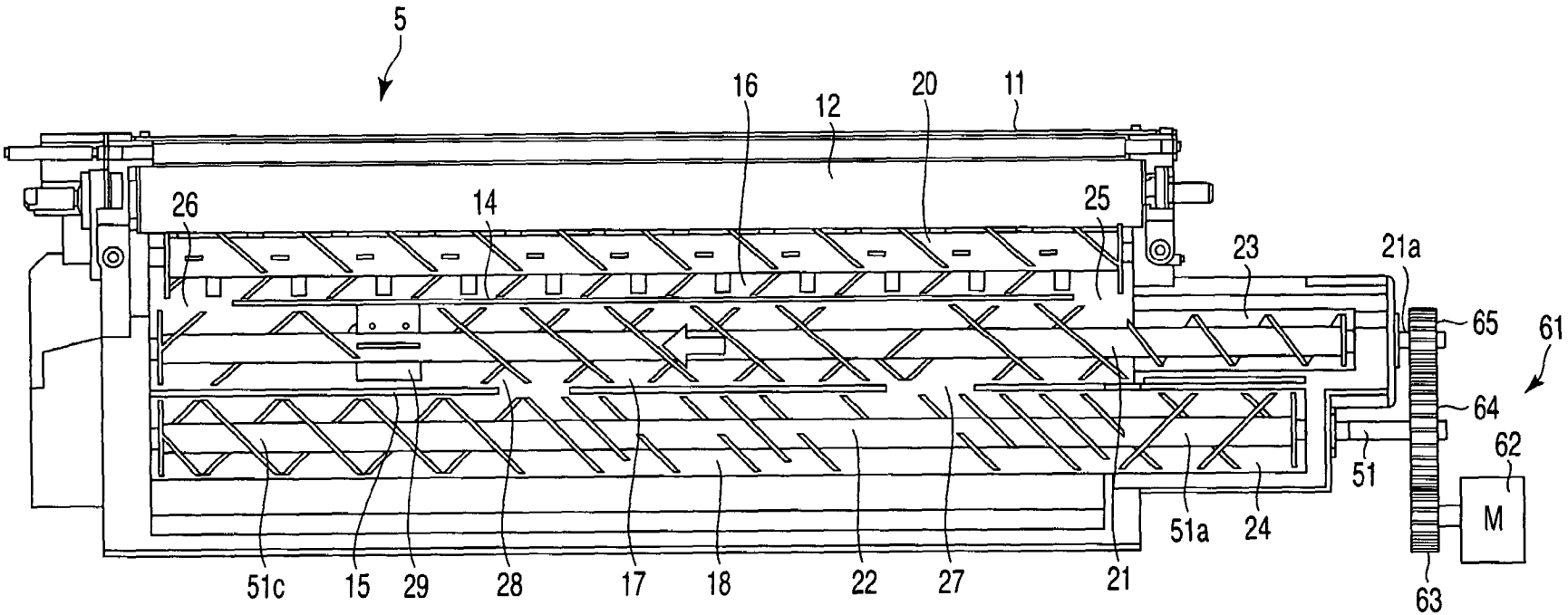
FIG. 4 is a plane view showing the internal structure of the developing unit.

As shown in FIG. 4, a first connecting opening 25 is formed at the other end of the first partition wall 14 and a fourth connecting opening 26 is formed at one end. These first and fourth connecting openings 25 and 26 connect the first and second chambers 16 and 17. Second and third connecting openings 27 and 28 are formed in the halfway of the second partition wall 15. These second and third connecting openings 27 and 28 connect the second and third chambers 17 and 18. The second connecting opening 27 of the second partition wall 15 is disposed in the downstream side of the first connecting opening 25 of the first partition wall 14 in the developer carrying direction, and the phase is different.

In the other end side of the developer reservoir 11, a fresh toner receiver 23 and a collected toner receiver 24 are projected. The end of the second mixer 21 is inserted into the fresh toner receiver 23, and the end of the third mixer 22 is inserted into the collected toner receiver 24.

In the second chamber 17, a toner density detector 29 is provided as a density detection device to detect the density of the developer stirred and carried by the second mixer 21.

The third connecting opening 28 is provided in the upstream side of the toner density detector 29 in the developer carrying direction, so that the developer fed to the second chamber 17 through the third connecting opening 28 is securely passed to the toner density detector 29.

Figure 5:
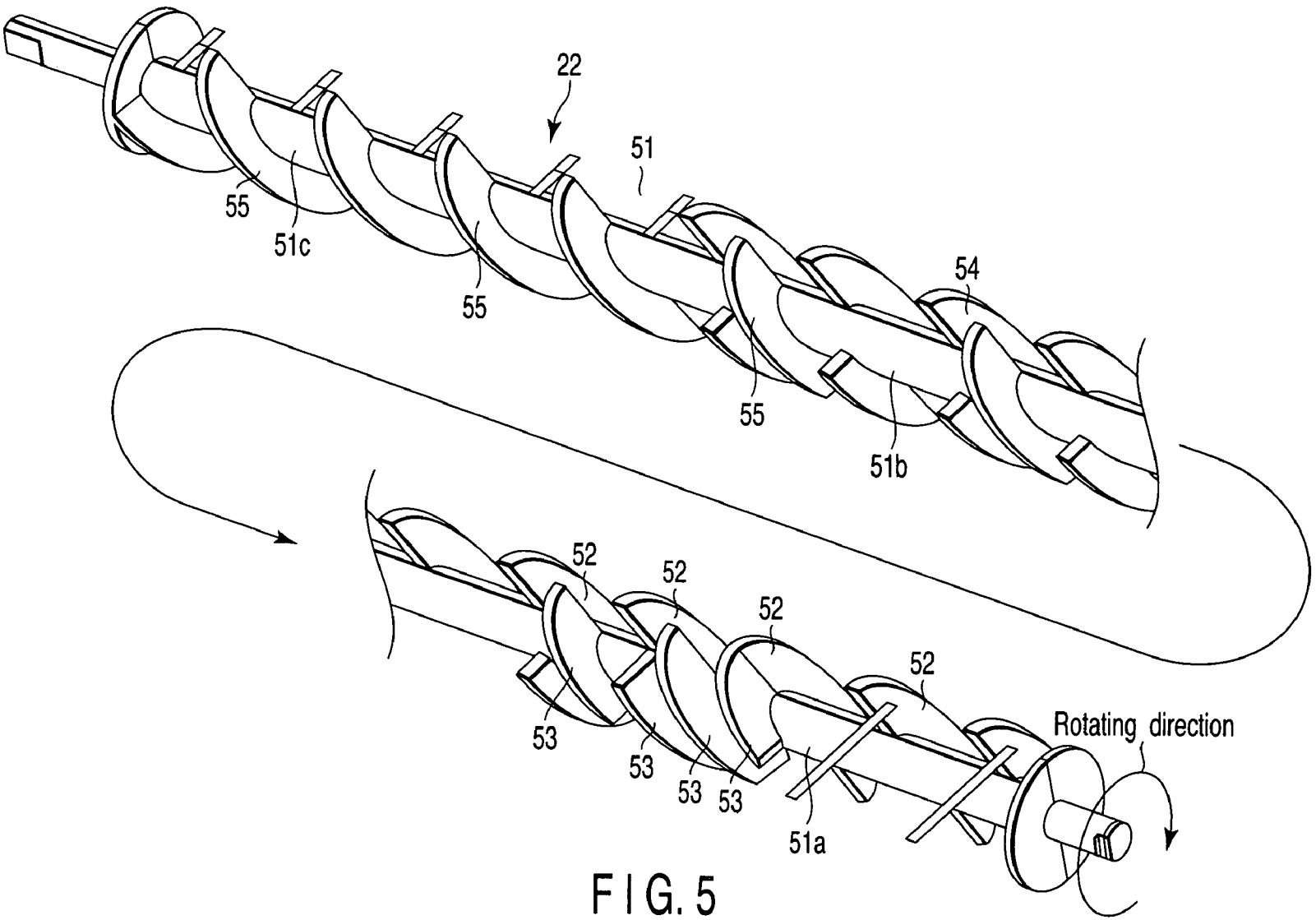
FIG. 5 is a divided perspective view showing a third mixer of the developing unit.
Figure 6:
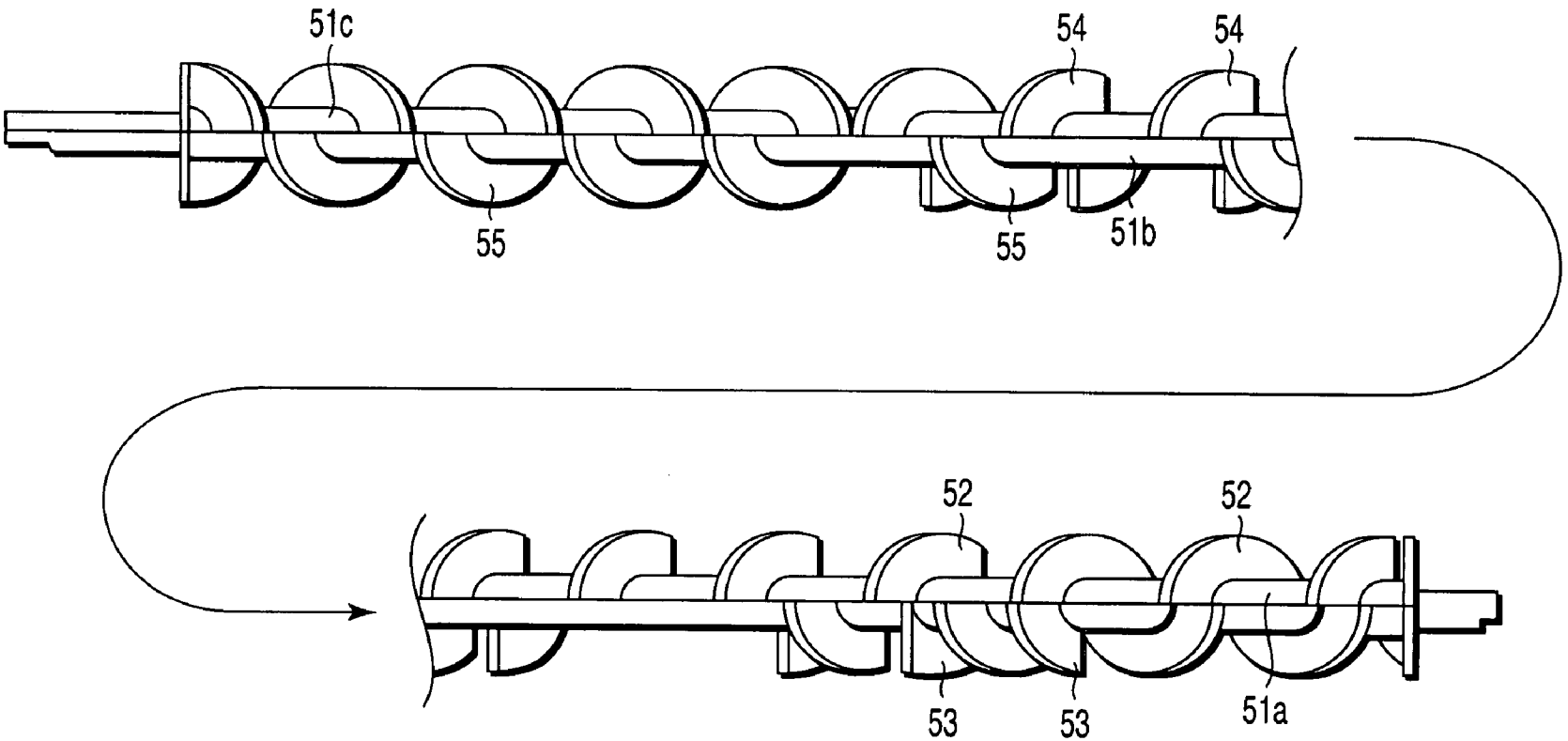
FIG. 6 is a top view showing the third mixer.
Figure 7:
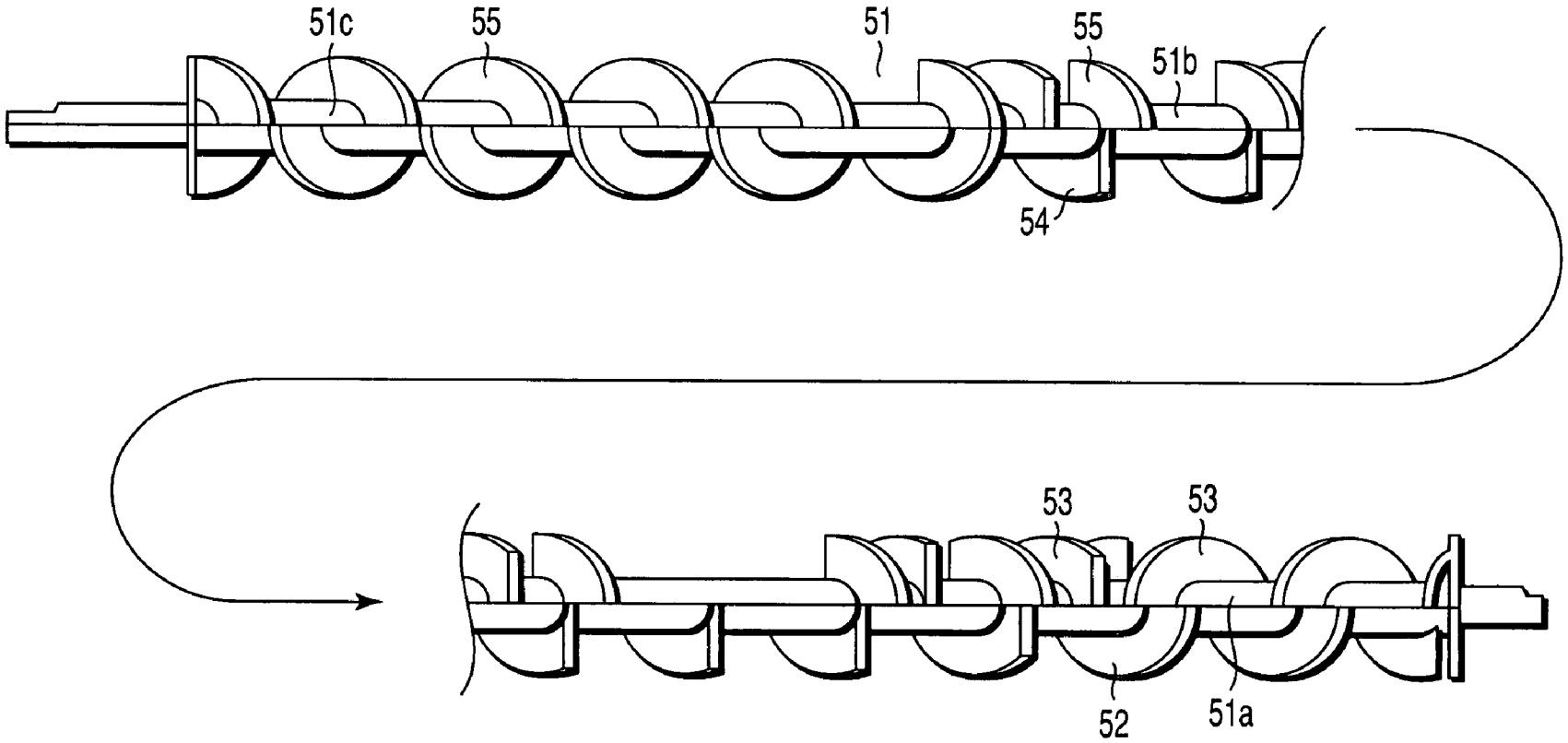
FIG. 7 is a bottom view showing the third mixer.

FIG. 5 is a perspective view showing the third mixer 22. FIG. 6 is a top view of the mixer. FIG. 7 is a bottom view of the mixer.

The third mixer has a rotary shaft 51. A forward feed blade 52 and reverse feed blade 53 are provided in the other end side of the rotary shaft 51, that is, in the part 51*a* located between the recycled toner receiver 24 and second connecting opening 27. A forward feed blade 54 is provided in the halfway of the rotary shaft, that is, in the part 51*b* located between the second connecting opening 27 and third connecting opening 28. A reverse feed blade 55 is provided in one end side of the rotary shaft, that is, in the part 51*c* from the third connecting opening 28 onward.

The total area ratio of the forward feed blade 52 to the reverse feed blade 53 provided in the part 51*a* in the other end side of the rotary shaft 51 is 1:0.77. The developer fed from the second connecting opening 27 into the third chamber 18 is once stirred and carried in the reverse direction, that is, toward the recycled toner receiver 24 by the rotation of the reverse feed blade 53, and then stirred and carried in the forward direction by the rotation of the forward feed blade 52.

The reverse feed blade 55 provided in the part 51*c* in one end side of the rotary shaft 51 is used to feed the developer fed by the rotation of the forward feed blade 54 reversely to the third connecting opening 28.

Figure 11:
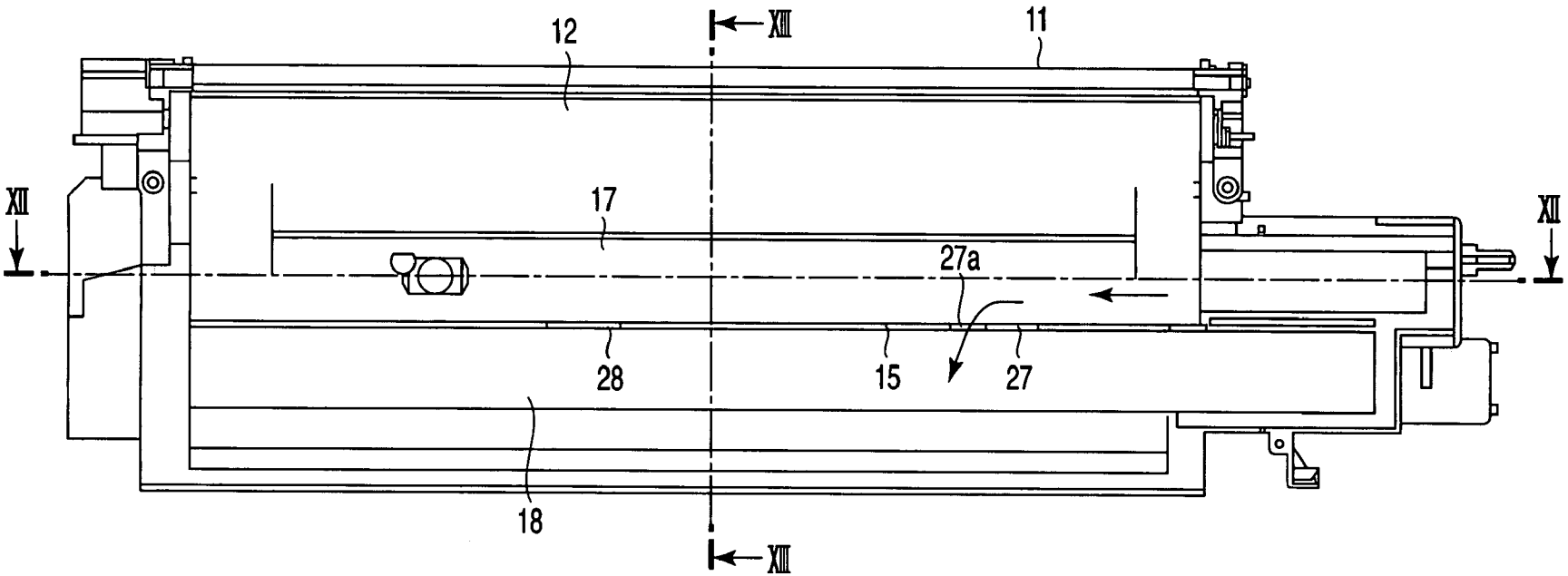
FIG. 11 is a plane view showing a developer reservoir of the developing unit according to an embodiment of the present invention.
Figure 12:
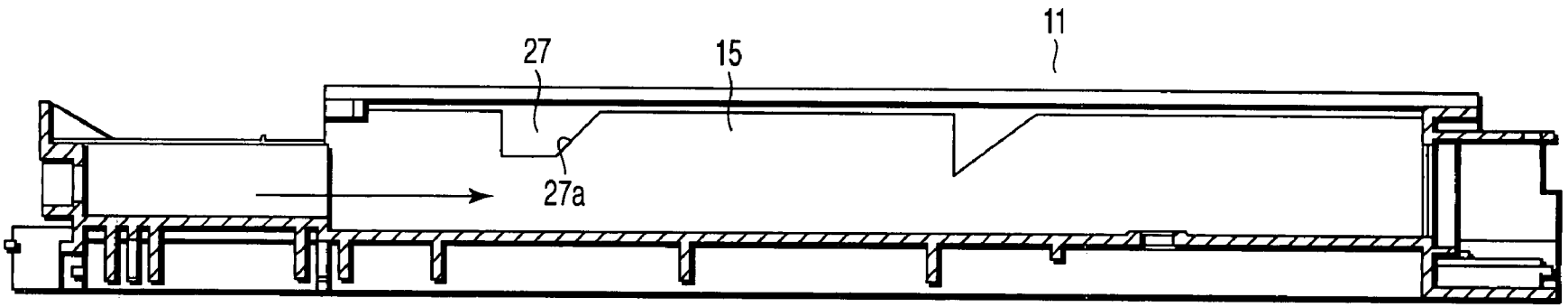
FIG. 12 is a sectional view taken along lines XII—XII of FIG. 11.
Figure 13:
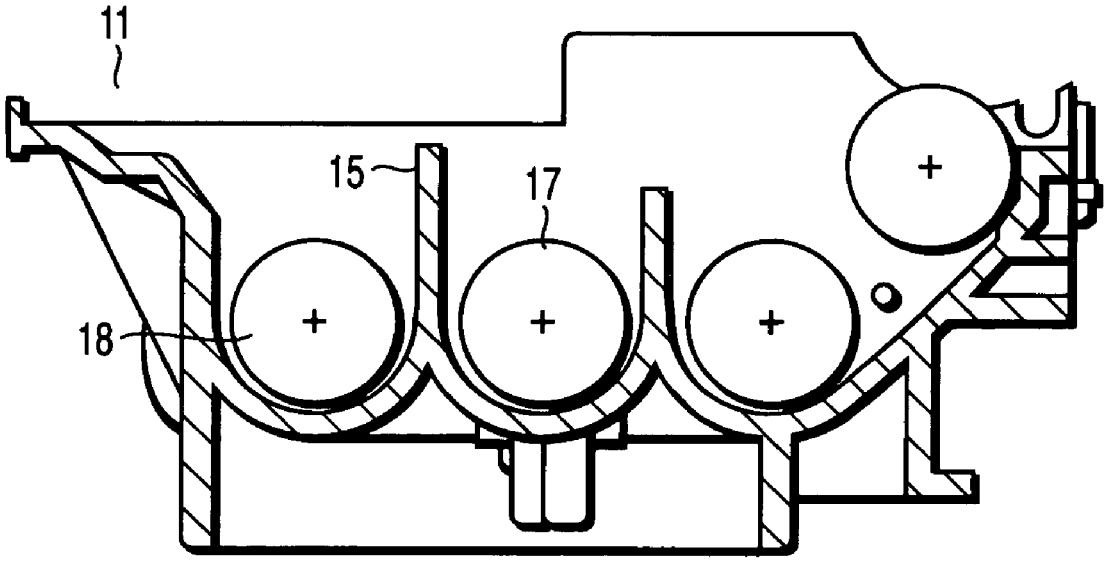
FIG. 13 is a sectional view taken along lines XIII—XIII of FIG. 11.

FIG. 11 is a plane view showing the developer reservoir 11. FIG. 12 is a sectional view taken along lines XII—XII of FIG. 11. FIG. 13 is a sectional view taken along lines XIII—XIII of FIG. 11.

The inside of the developer reservoir 11 is divided into the second and third chambers 17 and 18 by the second partition wall 15. The second partition wall 15 is provided with the second connecting opening 27. The second connecting opening 27 is formed as shown in FIG. 12.

The second connecting opening 27 is formed in the second partition wall 15 just like sinking from the upper end of the wall. One of the opposed surfaces of the connecting opening in the downstream side of the developer carrying direction is a slope 27*a* inclined a certain angle to the developer carrying direction.

When the developer carried by the second mixer 21 reaches the second connecting opening 27, a part of the developer is guided by the slope 27*a* of the second connecting opening 27 and flowed smoothly into the third chamber 18.

Next, explanation will be given on the developing operation of the developing unit 5 configured as described above with reference to FIG. 8.

The developer in the developer reservoir 11 is stirred and carried in the first direction from one end side to the other end side, as indicated by an arrow, by the rotation of the first mixer 20, and supplied to the developing roller 12. The developer is supplied to the static latent image on the photoconductor drum 2 by the rotation of the developing roller 12, and the latent image is visualized.

The developer carried out from the first mixer 20 is guided into the second chamber 17 through the first connecting opening 25 of the first partition wall 14, and carried in the arrow direction (the second direction) by the rotation of the second mixer 21. The developer carried out from the second mixer 21 is fed to one end side of the first mixer 20 through the fourth connecting opening 26, and circulated to the first mixer 20.

The developer carried by the second mixer 21 is partially fed from the second connecting opening 27 of the second partition wall 15 into the third chamber 18, and carried in the arrow direction (the second direction). This developer is fed again from the third connecting opening 28 of the second partition wall 15 into the second chamber 17, stirred and carried by the second mixer 21, and fed to one end side of the first mixer 20 through the fourth connecting opening 26.

The developer stirred and carried by the second mixer 21 is detected the toner density by the toner density detector 29. If the toner density detected by the toner density detector 29 is lower than a predetermined value, toner is replenished from the toner replenish device 8. This toner is dropped into the fresh toner receiver 23 of the developer reservoir 11. This fresh toner is stirred and carried in the arrow direction (the second direction) by the rotation of the second mixer 21, and fed to one end side of the first mixer 20 as described above.

The toner collected from the cleaning unit 7 by the collection mechanism 10 is dropped into the recycled toner receiver 24. This recycled toner is carried in the arrow direction (the second direction) by the rotation of the third mixer 22. In this time, the developer fed from the second connecting opening 27 into the third chamber 18 is once stirred and carried in the reverse direction as indicated by the arrow a, that is, toward the recycled toner receiver 24 by the rotation of the reverse feed blade 53, and then stirred and carried in the forward direction as indicated by the arrow b, that is, toward the second direction by the rotation of the forward feed blade 52. This developer is fed to one end side of the first mixer 20 through the third connecting opening 28 as described above.

The developer fed to the downstream side of the carrying direction without being fed to the second chamber 17 through the third connecting opening 28, is fed reversely and returned to the third connecting opening 28 by the rotation of the reverse feed blade 55, and fed to the second chamber 17 through the third connecting opening 28.

As described above, according to this embodiment, the developer stirring and carrying speed of the third mixer 22 of the developing unit 5 is reduced to about ¼–⅙ of the developer stirring and carrying speed of the third mixer 21, and the recycled toner stirring and carrying time can be set longer than the fresh toner stirring and carrying time, and the recycled toner charging level can be increased so much.

Further, the second connecting opening 27 is formed in the downstream side of the first connecting opening 25 in the developer feeding direction, and the developer is not rapidly flowed from the first chamber 16 into the third chamber 18 even if the machine is inclined. Therefore, if the machine is inclined, the change in the developer feeding volume is minimized, and the performance is hard to be influenced by the fluctuation in the developer input timing due to increase/decrease of the toner ratio and density.

The third connecting opening 28 of the second partition wall 15 is provided in the upstream side of the toner density detector 29 in the developer feeding direction, and the developer fed into the second chamber 17 through the third connecting opening 28 can be securely passed to the toner density detector 29. Therefore, the fluctuation in the toner density due to the input of recycled toner can be reflected to the fresh toner replenish amount, the excessive replenish of toner is prevented, and a defect such as fogging of an image can be prevented.

The developer fed from the second connecting opening 27 into the third chamber 18 is once stirred and carried in the reverse direction by the rotation of the reverse feed blade 53 of the third mixer 22, and then stirred and carried in the forward direction by the rotation of the forward feed blade 52. Therefore, the recycled toner inputted from the recycled toner receiver 24 and adhered to the inside is scraped off by the carrier of the reversely fed developer and carried in the forward direction without clogging.

The developer carried by the second mixer 21 is partially fed into the third chamber 18 through the second connecting opening 27, and the recycled toner in the third chamber 18 can be charged by friction caused by the carrier of developer and be given sufficient amount of electric charge.

The recycled toner carried by the third mixer 22 is fed into the second chamber 17 from the third connecting opening 28, and mixed sufficiently with the developer carried by the second mixer 21, and sent to the first mixer 20, enabling good development.

The third connecting opening 28 can be provided in the upstream side of the fourth connecting opening 27 in the developer carrying direction and a certain distance is taken, and the time to mix the recycled toner with the developer in the second chamber can be obtained.

Of the recycled toner carried by the third mixer 22, the toner which is to the downstream side of the third connecting opening 28 without being fed into the second chamber 17 through the third connecting opening 28 is reversely sent to the third connecting opening 28 by the rotation of the reverse feed blade 55 of the third mixer 22, and the toner can be securely reused without being stayed in the downstream side in the feeding direction. Besides, as the developers carried by the forward feed blade 54 and reverse feed blade 55 are bumped each other near the third connecting opening 28, the developers are well mixed and the charging efficiency is improved.

The second connecting opening 27 is formed in the second partition wall 15 just like sinking from the upper end, and one of the opposed surfaces of the connecting opening in the downstream side of the developer carrying direction is the slope 27*a* inclined a certain angle to the developer carrying direction. When the developer carried by the second mixer 21 reaches the second connecting opening 27, a part of the developer is guided by the slope 27*a* of the second connecting opening 27 and flowed smoothly into the third chamber 18, and the recycled toner can be charged well by friction.

As an image holding element, a belt type is permitted in addition to a photoconductor drum. As a charging charger, a wire type or roller type is permitted.

As a charging charger, a wire type or roller type is allowed. As an image forming means, an LED or the like is allowed in addition to a laser unit.

As a transfer device, a roller type is allowed in addition to a transfer charger (corona wire).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying member which is provided in the first chamber, and supplies developer to the developing roller by stirring and carrying in a first direction from one end side to the other end side of the chamber;

a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a third stirring and carrying member which is provided in the third chamber, and feeds the toner collected by the collection device to one end side of the first stirring and carrying member by stirring and carrying in the second direction at a speed lower than the second stirring and carrying member.

2. The image forming apparatus according to claim 1, wherein the developer carrying speed of the third stirring and carrying member is approximately ¼–⅙ of the developer carrying speed of the second stirring and carrying member.

3. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

first and second partition members which divide the inside of the developer reservoir into first to third chambers substantially parallel to the developing roller;

a first connecting opening which is formed in the first partition member, and connect the first and second chambers;

a second connecting opening which is formed in the second partition member in the downstream side of the first connecting opening in the developer carrying direction, and connects the second and third chambers;

a first stirring and carrying member which is provided in the first chamber, and supplies developer to the developing roller by stirring and carrying in a first direction from one end side to the other end side of the chamber;

a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a third stirring and carrying member which is provided in the third chamber, and feeds by stirring and carrying the toner collected by the collection device and developer fed from the second chamber to the third chamber through the second connecting opening to one end side of the first stirring and carrying member.

4. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

first and second partition members which divide the inside of the developer reservoir into first to third chambers substantially parallel to the developing roller;

a first connecting opening which is formed in the first partition member, and connects the first and second chambers;

second and third connecting openings which are formed in the second partition member, and connect the second and third chambers;

a first stirring and carrying member which is provided in the first chamber, and supplies developer to the developing roller by stirring and carrying the developer in a first direction from one end side to the other end side of the chamber;

a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a density detection device which is provided in the second chamber in the downstream side of the third connecting opening in the developer carrying direction, and detects the density of the developer stirred and carried by the second stirring and carrying member;

a third stirring and carrying member which is provided in the third chamber, and feeds the toner collected by the collection device and developer fed from the second chamber to the third chamber through the second connecting opening to the second chamber through the third connecting opening, after stirring and carrying in the second direction.

5. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying member which is provided in the first chamber, and supplies developer to the developing roller by stirring and carrying in a first direction from one end side to the other end side of the chamber;

a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a third stirring and carrying member which is provided in the third chamber, carries the developer fed from the second chamber to the third chamber through the second connecting opening once in the direction reverse to the second direction, and feeds the developer together with the toner collected from the collection device to one end side of the first stirring and carrying member by stirring and carrying in the second direction.

6. The image forming apparatus according to claim 5, wherein the third stirring and carrying member has a reverse feed blade which carries the developer fed to the third chamber through the second connecting opening in the direction reverse to the second direction, and a forward feed blade which carries the developer in the second direction; and the total area ratio of the forward feed blade to the reverse feed blade is 1:0.77.

7. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying member which is provided in the first chamber, and supplies developer to the developing roller by stirring and carrying in a first direction from one end side to the other end side of the chamber;

a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a third stirring and carrying member which is provided in the third chamber, and feeds the toner collected by the collection device and the developer fed from the second chamber to the third chamber through the second connecting opening to one end side of the first stirring and carrying member by stirring and carrying in the second direction.

8. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying member which is provided in the first chamber, and supplies developer to the developing roller by stirring and carrying in a first direction from one end side to the other end side of the chamber;

a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a third stirring and carrying member which is provided in the third chamber, and feeds the toner collected by the collection device to the second chamber through the second connecting opening after stirring and carrying in the second direction.

9. The image forming apparatus according to claim 8, further comprising a third connecting opening which is formed in the second partition member in the upstream side of the second connecting opening in the toner carrying direction, and connects the second and third chambers.

10. The image forming apparatus according to claim 8, further comprising a fourth connecting opening which is formed in the first partition member in the upstream side of the first connecting opening in the toner carrying direction, and connects the first and second chambers.

11. The image forming apparatus according to claim 1, further comprising a driving device which rotates and drives the second and third stirring and carrying members, wherein the driving device has a single driving source, and power transmission devices which transmit the power of the driving source to the second and third stirring and carrying members with a different rotation ratio.

12. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying member which is provided in the first chamber, and supplies developer to the developing roller by stirring and carrying in a first direction from one end side to the other end side of the chamber;

a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a third stirring and carrying member which is provided in the third chamber, and has a forward feed blade and a reverse feed blade, feeds the toner collected by the collection device from the second connecting opening to the second chamber by stirring and carrying in the second direction by the rotation of the forward feed blade, and returns the developer not fed from the second connecting opening to the second chamber to the second connecting opening by the rotation of the reverse feed blade.

13. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

first and second partition members which divide the inside of the developer reservoir into first to third chambers substantially parallel to the developing roller;

a first connecting opening which is formed in the first partition member, and connects the first and second chambers;

a second connecting opening which has a notch formed at the upper end of the second partition member, and connects the second and third chambers through the notch, the notch having separated and opposed notch surfaces, and the notch surface of the downstream side of the developer carrying direction forming a slope 27*a* inclined a predetermined angle toward the developer carrying direction;

a first stirring and carrying member which is provided in the first chamber, and supplies developer to the developing roller by stirring and carrying in a first direction from one end side to the other end side of the chamber;

a second stirring and carrying member which is provided in the second chamber, and feeds the toner replenished from the replenish device and developer fed from the first chamber to the second chamber through the first connecting opening to one end side of the first stirring and carrying member by stirring and carrying in a second direction reverse to the first direction; and a third stirring and carrying member which is provided in the third chamber, and feeds the toner collected by the collection device and developer fed from the second chamber to the third chamber through the second connecting opening to one end side of the first stirring and carrying member by stirring and carrying.

14. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying means which is provided in the first chamber, and supplies developer to the developing roller by stirring and carrying in a first direction from one end side to the other end side of the chamber;

a second stirring and carrying means which is provided in the second chamber, and feeds the toner replenished from the replenish means and developer fed from the first chamber to the second chamber through the first connecting opening to one end side of the first stirring and carrying means by stirring and carrying in a second direction reverse to the first direction; and a third stirring and carrying means which is provided in the third chamber, and feeds the toner collected by the collection means to one end side of the first stirring and carrying means by stirring and carrying in the second direction at a speed lower than the second stirring and carrying means.

15. The image forming apparatus according to claim 14, wherein the developer carrying speed of the third stirring and carrying means is approximately ¼–⅙ of the developer carrying speed of the second stirring and carrying means.

16. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member in the downstream side of the first connecting opening in the developer carrying direction, and connects the second and third chambers;

a first stirring and carrying means which is provided in the first chamber, and supplies developer to the developing roller by stirring and carrying in a first direction from one end side to the other end side of the chamber;

a second stirring and carrying means which is provided in the second chamber, and feeds the toner replenished from the replenish means and developer fed from the first chamber to the second chamber through the first connecting opening to one end side of the first stirring and carrying means by stirring and carrying in a second direction reverse to the first direction; and a third stirring and carrying means which is provided in the third chamber, and feeds the toner collected by the collection means and developer fed from the second chamber to the third chamber through the second connecting opening to one end side of the first stirring and carrying means by stirring and carrying in the second direction.

17. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

first and second partition members which divide the inside of the developer reservoir into first to third chambers substantially parallel to the developing roller;

a first connecting opening which is formed in the first partition member, and connects the first and second chambers;

second and third connecting openings which are formed in the second partition member, and connect the second and third chambers;

a first stirring and carrying means which is provided in the first chamber, and supplies developer to the developing roller by stirring and carrying in a first direction from one end side to the other end side of the chamber;

a second stirring and carrying means which is provided in the second chamber, and feeds the toner replenished from the replenish means and developer fed from the first chamber to the second chamber through the first connecting opening to one end side of the first stirring and carrying means by stirring and carrying in a second direction reverse to the first direction; and a density detection means which is provided in the second chamber in the downstream side of the third connecting opening in the developer carrying direction, and detects the density of the developer stirred and carried by the second stirring and carrying member;

a third stirring and carrying means which is provided in the third chamber, and feeds the toner collected by the collection means and developer fed from the second chamber to the third chamber through the second connecting opening to the second chamber through the third connecting opening after stirring and carrying in the second direction.

18. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

first and second partition members which divide the inside of the developer reservoir into first to third chambers substantially parallel to the developing roller;

a first connecting opening which is formed in the first partition member, and connects the first and second chambers;

a second connecting openings which is formed in the second partition member, and connects the second and third chambers;

a first stirring and carrying means which is provided in the first chamber, and supplies developer to the developing roller by stirring and carrying in a first direction from one end side to the other end side of the chamber;

a second stirring and carrying means which is provided in the second chamber, and feeds the toner replenished from the replenish means and developer fed from the first chamber to the second chamber through the first connecting opening to one end side of the first stirring and carrying means by stirring and carrying in a second direction reverse to the first direction; and a third stirring and carrying means which is provided in the third chamber, carries the developer fed from the second chamber once in the direction reverse to the second direction, and feeds the developer together with the toner collected from the collection means to one end side of the first stirring and carrying means by stirring and carrying in the second direction.

19. The image forming apparatus according to claim 18, wherein the third stirring and carrying means has a reverse feed blade which carries the developer fed into the third chamber through the second connecting opening in the direction reverse to the second direction, and a forward feed blade which carries the developer in the second direction; and the total area ratio of the forward feed blade to the reverse feed blade is 1:0.77.

20. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying means which is provided in the first chamber, and supplies developer to the developing roller by stirring and carrying in a first direction from one end side to the other end side of the chamber;

a second stirring and carrying means which is provided in the second chamber, and feeds the toner replenished from the replenish means and developer fed from the first chamber to the second chamber through the first connecting opening to one end side of the first stirring and carrying means by stirring and carrying in a second direction reverse to the first direction; and a third stirring and carrying means which is provided in the third chamber, and feeds the toner collected by the collection means and developer fed from the second chamber to the third chamber through the second connecting opening to one end side of the first stirring and carrying member by stirring and carrying in the second direction.

21. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying means which is provided in the first chamber, and supplies developer to the developing roller by stirring and carrying in a first direction from one end side to the other end side of the chamber;

a second stirring and carrying means which is provided in the second chamber, and feeds the toner replenished from the replenish means and developer fed from the first chamber to the second chamber through the first connecting opening to one end side of the first stirring and carrying means by stirring and carrying in a second direction reverse to the first direction; and a third stirring and carrying means which is provided in the third chamber, and feeds the toner collected by the collection means to the second chamber through the second connecting opening after stirring and carrying in the second direction.

22. The image forming apparatus according to claim 21, further comprising a third connecting opening which is formed in the second partition member in the upstream side of the second connecting opening in the toner carrying direction, and connects the second and third chambers.

23. The image forming apparatus according to claim 21, further comprising a fourth connecting opening which is formed in the first partition member in the upstream side of the first connecting opening in the toner carrying direction, and connects the first and second chambers.

24. The image forming apparatus according to claim 14, further comprising a driving means which rotates and drives the second and third stirring and carrying means, wherein the driving device has a single driving source, and power transmission means which transmit the power of the driving source to the second and third stirring and carrying means with a different rotation ratio.

25. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

first and second partition members which divide the inside of the developer reservoir into first to third chambers substantially parallel to the developing roller;

a first connecting opening which is formed in the first partition member, and connects the first and second chambers;

a second connecting opening which is formed in the second partition member, and connects the second and third chambers;

a first stirring and carrying means which is provided in the first chamber, and supplies developer to the developing roller by stirring and carrying in a first direction from one end side to the other end side of the chamber;

a second stirring and carrying means which is provided in the second chamber, and feeds the toner replenished from the replenish means and developer fed from the first chamber to the second chamber through the first connecting opening to one end side of the first stirring and carrying means by stirring and carrying in a second direction reverse to the first direction; and a third stirring and carrying means which is provided in the third chamber, and has a forward feed blade and a reverse feed blade, feeds the toner collected by the collection means from the second connecting opening to the second chamber by stirring and carrying in the second direction by the rotation of the forward feed blade, and returns the developer not fed from the second connecting opening to the second chamber to the second connecting opening by the rotation of the reverse feed blade.

26. An image forming apparatus, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

first and second partition members which divide the inside of the developer reservoir into first to third chambers substantially parallel to the developing roller;

a first connecting opening which is formed in the first partition member, and connects the first and second chambers;

a second connecting opening which has a notch formed at the upper end of the second partition member, and connects the second and third chambers through this notch, the notch having separated and opposed notch surfaces, and the notch surface of the downstream side of the developer carrying direction forming a slope 27*a* inclined a predetermined angle toward the developer carrying direction;

a first stirring and carrying means which is provided in the first chamber, and supplies developer to the developing roller by stirring and carrying in a first direction from one end side to the other end side of the chamber;

a second stirring and carrying means which is provided in the second chamber, and feeds the toner replenished from the replenish means and developer fed from the first chamber to the second chamber through the first connecting opening to one end side of the first stirring and carrying means by stirring and carrying in a second direction reverse to the first direction; and a third stirring and carrying means which is provided in the third chamber, and feeds the toner collected by the collection means and developer fed from the second chamber to the third chamber through the second connecting opening to one end side of the first stirring and carrying means by stirring and carrying.

27. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the second and third chambers;

supplying the developer in the first chamber to the developing roller by a first stirring and carrying member by stirring and carrying in a first direction from one end side to the other end side of the chamber;

feeding the toner replenished from the replenish device and developer fed from the first chamber to the second chamber through the first connecting opening to one end side of the first stirring and carrying member by a second stirring and carrying member by stirring and carrying in a second direction reverse to the first direction; and feeding the toner collected by the collection device to one end side of the first stirring and carrying member by a third stirring and carrying member by stirring and carrying in the second direction at a speed lower than the second stirring and carrying member.

28. The image forming method according to claim 27, wherein the third stirring and carrying member carries the developer at a speed of approximately ¼–⅙ of the developer carrying speed of the second stirring and carrying member.

29. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member in the downstream side of the first connecting opening in the developer carrying direction, and connecting the second and third chambers;

supplying the developer in the first chamber to the developing roller by a first stirring and carrying member by stirring and carrying in a first direction from one end side to the other end side of the chamber;

feeding the toner replenished from the replenish device and developer fed from the first chamber to the second chamber through the first connecting opening to one end side of the first stirring and carrying member by a second stirring and carrying member by stirring and carrying in a second direction reverse to the first direction; and feeding the toner collected by the collection device and developer fed from the second chamber to the third chamber through the second connecting opening to one end side of the first stirring and carrying member by a third stirring and carrying member by stirring and carrying in the second direction.

30. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

dividing the inside of the developer reservoir into first to third chambers substantially parallel to the developing roller by first and second partition members;

forming a first connecting opening in the first partition member, and connecting the first and second chambers;

forming second and third connecting openings in the second partition member, and connecting the second and third chambers;

supplying the developer in the first chamber to the developing roller by a first stirring and carrying member by stirring and carrying in a first direction from one end side to the other end side of the chamber;

feeding the toner replenished from the replenish device and developer fed from the first chamber to the second chamber through the first connecting opening to one end side of the first stirring and carrying member by a second stirring and carrying member by stirring and carrying in a second direction reverse to the first direction;

detecting the density of the developer stirred and carried by the second stirring and carrying member by a density detection device which is provided in the second chamber in the downstream side of the third connecting opening in the developer carrying direction;

feeding the toner collected by the collection device and developer fed from the second chamber to the third chamber through the second connecting opening to the second chamber through the third connecting opening by a third stirring and carrying member after stirring and carrying in the second direction.

31. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

dividing the inside of the developer reservoir into first to third chambers substantially parallel to the developing roller by first and second partition members;

forming a first connecting opening in the first partition member, and connecting the first and second chambers;

forming a second connecting openings in the second partition member, and connecting the second and third chambers;

supplying the developer in the first chamber to the developing roller by a first stirring and carrying member by stirring and carrying in a first direction from one end side to the other end side of the chamber;

feeding the toner replenished from the replenish device and developer fed from the first chamber to the second chamber through the first connecting opening to one end side of the first stirring and carrying member by a second stirring and carrying member by stirring and carrying in a second direction reverse to the first direction; and feeding the developer fed from the second chamber to the third chamber through the second connecting opening to one end side of the first stirring and carrying member together with the toner collected from the collection device by a third stirring and carrying member by stirring and carrying in the second direction, after once carrying in the direction reverse to the second direction.

32. The image forming method according to claim 31, wherein the third stirring and carrying member carries the developer fed to the third chamber through the second connecting opening by the rotation of a forward feed blade and reverse feed blade whose total area ratio is 1:0.77.

33. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the second and third chambers;

supplying the developer in the first chamber to the developing roller by a first stirring and carrying member by stirring and carrying in a first direction from one end side to the other end side of the chamber;

feeding the toner replenished from the replenish device and developer fed from the first chamber to the second chamber through the first connecting opening to one end side of the first stirring and carrying member by a second stirring and carrying member by stirring and carrying in a second direction reverse to the first direction; and feeding the toner collected by the collection device and developer fed from the second chamber to the third chamber through the second connecting opening to one end side of the first stirring and carrying member by a third stirring and carrying member by stirring and carrying in the second direction.

34. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the second and third chambers;

supplying the developer in the first chamber to the developing roller by a first stirring and carrying member by stirring and carrying in a first direction from one end side to the other end side of the chamber;

feeding the toner replenished from the replenish device and developer fed from the first chamber to the second chamber through the first connecting opening to one end side of the first stirring and carrying member by a second stirring and carrying member by stirring and carrying in a second direction reverse to the first direction; and feeding the toner collected by the collection device to the second chamber through the second connecting opening by a third stirring and carrying member, after stirring and carrying in the second direction.

35. The image forming method according to claim 34, wherein a third connecting opening is formed in the second partition member in the upstream side of the second connecting opening in the toner carrying direction, and the second and third chambers are connected through the third connecting opening.

36. The image forming method according to claim 34, wherein a fourth connecting opening is formed in the first partition member in the upstream side of the first connecting opening in the toner carrying direction, and the first and second chambers are connected through the fourth connecting opening.

37. The image forming method according to claim 27, wherein power of a single driving source is transmitted to the second and third stirring and carrying members through power transmission devices with a different rotation ratio, to rotate and drive the second and third stirring and carrying members.

38. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the second and third chambers;

supplying the developer in the first chamber to the developing roller by a first stirring and carrying member by stirring and carrying in a first direction from one end side to the other end side of the chamber;

feeding the toner replenished from the replenish device and developer fed from the first chamber to the second chamber through the first connecting opening to one end side of the first stirring and carrying member by a second stirring and carrying member by stirring and carrying in a second direction reverse to the first direction; and feeding the toner collected by the collection device from the second connecting opening to the second chamber by stirring and carrying in the second direction by the rotation of a forward feed blade of a third stirring and carrying member, and returning the developer not fed from the second connecting opening to the second chamber to the second connecting opening by the rotation of a reverse feed blade.

39. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection device, and replenishes toner to the developer reservoir by a toner replenish device, comprising:

dividing the inside of the developer reservoir into first to third chambers substantially parallel to the developing roller by first and second partition members;

forming a first connecting opening in the first partition member, and connecting the first and second chambers;

connecting the second and third chambers by a second connecting opening which is formed as a notch at the upper end of the second partition member and has separated and opposed notch surfaces, one of the notch surfaces in the downstream side of the developer carrying direction forming a slope 27*a* inclined a predetermined angle toward the developer carrying direction;

supplying the developer in the first chamber to the developing roller by a first stirring and carrying member by stirring and carrying in a first direction from one end side to the other end side of the chamber;

feeding the toner replenished from the replenish device and developer fed from the first chamber to the second chamber through the first connecting opening to one end side of the first stirring and carrying member by a second stirring and carrying member by stirring and carrying in a second direction reverse to the first direction; and feeding the toner collected by the collection device and developer fed from the second chamber to the third chamber through the second connecting opening to one end side of the first stirring and carrying member by stirring and carrying by the third stirring and carrying member.

40. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the first and second chambers;

supplying the developer in the first chamber to the developing roller by a first stirring and carrying member by stirring and carrying in a first direction from one end side to the other end side of the chamber;

feeding the toner replenished from the replenish means and developer fed from the first chamber to the second chamber through the first connecting opening to one end side of the first stirring and carrying member by a second stirring and carrying member by stirring and carrying in a second direction reverse to the first direction; and feeding the toner collected by the collection means to one end side of the first stirring and carrying member by a third stirring and carrying member by stirring and carrying in the second direction at a speed lower than the second stirring and carrying member.

41. The image forming method according to claim 40, wherein the third stirring and carrying member carries the developer at a speed of approximately ¼–⅙ of the developer carrying speed of the second stirring and carrying member.

42. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member in the downstream side of the first connecting opening in the developer carrying direction, and connecting the first and second chambers;

supplying the developer in the first chamber to the developing roller by a first stirring and carrying member by stirring and carrying in a first direction from one end side to the other end side of the chamber;

feeding the toner replenished from the replenish means and developer fed from the first chamber to the second chamber through the first connecting opening to one end side of the first stirring and carrying member by a second stirring and carrying member by stirring and carrying in a second direction reverse to the first direction; and feeding the toner collected by the collection means and developer fed from the second chamber to the third chamber through the second connecting opening to one end side of the first stirring and carrying member by stirring and carrying in the second direction by a third stirring and carrying member.

43. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

dividing the inside of the developer reservoir into first to third chambers substantially parallel to the developing roller by first and second partition members;

forming a first connecting opening in the first partition member, and connecting the first and second chambers;

forming second and third connecting openings in the second partition member, and connecting the first and second chambers;

supplying the developer in the first chamber to the developing roller by a first stirring and carrying member by stirring and carrying in a first direction from one end side to the other end side of the chamber;

feeding the toner replenished from the replenish means and developer fed from the first chamber to the second chamber through the first connecting opening to one end side of the first stirring and carrying member by a second stirring and carrying member by stirring and carrying in a second direction reverse to the first direction;

detecting the density of the developer stirred and carried by the second stirring and carrying member by a density detection means which is provided in the second chamber in the downstream side of the third connecting opening in the developer carrying direction; and feeding the toner collected by the collection means and developer fed from the second chamber to the third chamber through the second connecting opening to the second chamber through the third connecting opening by a third stirring and carrying member, after stirring and carrying in the second direction.

44. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the first and second chambers;

supplying the developer in the first chamber to the developing roller by a first stirring and carrying member by stirring and carrying in a first direction from one end side to the other end side of the chamber;

feeding the toner replenished from the replenish means and developer fed from the first chamber to the second chamber through the first connecting opening to one end side of the first stirring and carrying member by a second stirring and carrying member by stirring and carrying in a second direction reverse to the first direction; and feeding the developer fed from the second chamber to the third chamber through the second connecting opening to one end side of the first stirring and carrying member together with the toner collected from the collection means by a third stirring and carrying member by stirring and carrying in the second direction, after once carrying in the direction reverse to the second direction.

45. The image forming method according to claim 44, wherein the third stirring and carrying member carries the developer fed to the third chamber through the second connecting opening by the rotation of a forward feed blade and reverse feed blade whose total area ratio is 1:0.77.

46. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the first and second chambers;

supplying the developer in the first chamber to the developing roller by a first stirring and carrying member by stirring and carrying in a first direction from one end side to the other end side of the chamber;

feeding the toner replenished from the replenish means and developer fed from the first chamber to the second chamber through the first connecting opening to one end side of the first stirring and carrying member by a second stirring and carrying member by stirring and carrying in a second direction reverse to the first direction; and feeding the toner collected by the collection means and developer fed from the second chamber to the third chamber through the second connecting opening to one end side of the first stirring and carrying member by stirring and carrying in the second direction by a third stirring and carrying member.

47. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the first and second chambers;

supplying the developer in the first chamber to the developing roller by a first stirring and carrying member by stirring and carrying in a first direction from one end side to the other end side of the chamber;

feeding the toner replenished from the replenish means and developer fed from the first chamber to the second chamber through the first connecting opening to one end side of the first stirring and carrying member by a second stirring and carrying member by stirring and carrying in a second direction reverse to the first direction; and feeding the toner collected by the collection means to the second chamber through the third connecting opening by a third stirring and carrying member, after stirring and carrying in the second direction.

48. The image forming method according to claim 47, wherein a third connecting opening is formed in the second partition member in the upstream side of the second connecting opening in the toner carrying direction, and the second and third chambers are connected through the third connecting opening.

49. The image forming method according to claim 47, wherein a fourth connecting opening is formed in the first partition member in the upstream side of the first connecting opening in the toner carrying direction, and the first and second chambers are connected through the fourth connecting opening.

50. The image forming method according to claim 40, wherein power of a single driving source is transmitted to the second and third stirring and carrying members through power transmission devices with a different rotation ratio, to rotate and drive the second and third stirring and carrying members.

51. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

dividing the inside of the developer reservoir into first to third chambers substantially parallel to the developing roller by first and second partition members;

forming a first connecting opening in the first partition member, and connecting the first and second chambers;

forming a second connecting opening in the second partition member, and connecting the first and second chambers;

supplying the developer in the first chamber to the developing roller by a first stirring and carrying member by stirring and carrying in a first direction from one end side to the other end side of the chamber;

feeding the toner replenished from the replenish means and developer fed from the first chamber to the second chamber through the first connecting opening to one end side of the first stirring and carrying member by a second stirring and carrying member by stirring and carrying in a second direction reverse to the first direction; and feeding the toner collected by the collection means from the second connecting opening to the second chamber by stirring and carrying in the second direction by the rotation of a forward feed blade of a third stirring and carrying member, and returning the developer not fed from the second connecting opening to the second chamber to the second connection opening by the rotation of a reverse feed blade.

52. An image forming method, which supplies a two-component developer composed of toner and carrier to an electrostatic latent image formed on an image holding element by a developing roller in a developer reservoir to make the latent image as a developer image, transfers the developer image to a material to be transferred, eliminates the toner remained on the image holding element and collects the toner to the developer reservoir by a collection means, and replenishes toner to the developer reservoir by a toner replenish means, comprising:

dividing the inside of the developer reservoir into first to third chambers substantially parallel to the developing roller by first and second partition members;

forming a first connecting opening in the first partition member, and connecting the first and second chambers;

connecting the second and third chambers by a second connecting opening which is formed as a notch at the upper end of the second partition member, and has separated and opposed notch surfaces, one of the notch surfaces in the downstream side of the developer carrying direction forming a slope 27*a* inclined a predetermined angle toward the developer carrying direction;

supplying the developer in the first chamber to the developing roller by a first stirring and carrying member by stirring and carrying in a first direction from one end side to the other end side of the chamber;

feeding the toner replenished from the replenish means and developer fed from the first chamber to the second chamber through the first connecting opening to one end side of the first stirring and carrying member by a second stirring and carrying member by stirring and carrying in a second direction reverse to the first direction; and feeding the toner collected by the collection means and developer fed from the second chamber to the third chamber through the second connecting opening to one end side of the first stirring and carrying member by stirring and carrying by a third stirring and carrying member.

* * * * *